US010794123B2

(12) United States Patent
Dietz

(10) Patent No.: US 10,794,123 B2
(45) Date of Patent: Oct. 6, 2020

(54) TRAVEL JOINT

(71) Applicant: Halliburton Energy Services, Inc., Houston, TX (US)

(72) Inventor: Wesley P. Dietz, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/310,373

(22) PCT Filed: Sep. 14, 2016

(86) PCT No.: PCT/US2016/051772
§ 371 (c)(1),
(2) Date: Dec. 14, 2018

(87) PCT Pub. No.: WO2018/052417
PCT Pub. Date: Mar. 22, 2018

(65) Prior Publication Data

US 2019/0257159 A1 Aug. 22, 2019

(51) Int. Cl.

| | |
|---|---|
| ***E21B 17/07*** | (2006.01) |
| ***E21B 41/00*** | (2006.01) |
| ***E21B 31/113*** | (2006.01) |
| ***E21B 17/02*** | (2006.01) |
| ***E21B 19/16*** | (2006.01) |

(52) U.S. Cl.
CPC ..... *E21B 17/07* (2013.01); *E21B 17/02* (2013.01); *E21B 19/16* (2013.01); *E21B 31/113* (2013.01); *E21B 41/0035* (2013.01)

(58) Field of Classification Search
CPC ..... E21B 17/07; E21B 41/0035; E21B 19/16; E21B 17/02
See application file for complete search history.

(56) References Cited

U.S. PATENT DOCUMENTS

| | | | |
|---|---|---|---|
| 2,937,007 | A | 5/1960 | Whittle |
| 3,230,740 | A | 1/1966 | Fox |
| 3,811,519 | A | 5/1974 | Driver |
| 3,920,084 | A | 11/1975 | Russell, Jr. |
| 3,998,280 | A | 12/1976 | Kisling, III |
| 4,035,023 | A | 7/1977 | Cockrell |

(Continued)

FOREIGN PATENT DOCUMENTS

| | | |
|---|---|---|
| AU | 2012381021 | 10/2015 |
| CA | 2226796 | 7/1998 |

(Continued)

OTHER PUBLICATIONS

International Search Report and Written Opinion of PCT Application No. PCT/US2016/051772 dated May 30, 2017: pp. 1-18.

*Primary Examiner* — Giovanna Wright
*Assistant Examiner* — Manuel C Portocarrero
(74) *Attorney, Agent, or Firm* — Chamberlain Hrdklicka

(57) ABSTRACT

A travel joint that provides fluid communication between at least two hydraulic control lines through a cavity in the travel joint. In certain embodiments, the travel joint includes a sleeve assembly, a piston assembly, and annular cavity between the piston assembly and the sleeve assembly. The sleeve assembly includes a sleeve passage configured to hydraulically couple to a hydraulic line. The piston assembly is telescopically moveable within the sleeve assembly and includes a piston passage configured to hydraulically couple to a second hydraulic line.

17 Claims, 8 Drawing Sheets

(56) References Cited

U.S. PATENT DOCUMENTS

| | | | |
|---|---|---|---|
| 4,828,050 | A | 5/1989 | Hashimoto |
| 4,901,806 | A | 2/1990 | Forrest |
| 6,352,110 | B1 | 3/2002 | Langseth et al. |
| 6,644,848 | B1 | 11/2003 | Clayton et al. |
| 6,736,905 | B2 | 5/2004 | Smith et al. |
| 6,826,343 | B2 | 11/2004 | Davis et al. |
| 7,219,747 | B2 | 5/2007 | Gleitman et al. |
| 7,398,822 | B2 | 7/2008 | Meijer et al. |
| 8,770,276 | B1 | 7/2014 | Nish et al. |
| 8,770,278 | B2 | 7/2014 | Lauderdale |
| 8,794,311 | B2 | 8/2014 | Lauderdale |
| 9,267,338 | B1 | 2/2016 | LeBlanc et al. |
| 9,822,636 | B2 | 11/2017 | Chu |
| 2008/0073086 | A1 | 3/2008 | Cook et al. |
| 2010/0101778 | A1 | 4/2010 | Lembcke |
| 2010/0224375 | A1 | 9/2010 | Du et al. |
| 2011/0185815 | A1 | 8/2011 | McCann |
| 2013/0008671 | A1 | 1/2013 | Booth |
| 2013/0025880 | A1 | 1/2013 | Richards et al. |
| 2014/0346772 | A1 | 11/2014 | Gutierrez-Lemini et al. |
| 2015/0204145 | A1 | 7/2015 | Richards et al. |
| 2015/0300122 | A1 | 10/2015 | George et al. |
| 2017/0306719 | A1 | 10/2017 | Jerez |

FOREIGN PATENT DOCUMENTS

| | | | |
|---|---|---|---|
| RU | 1806257 | | 3/1993 |
| RU | 2025567 | C1 | 12/1994 |
| RU | 2439284 | C2 | 1/2012 |
| RU | 2468179 | C2 | 11/2012 |
| WO | 2001090532 | | 11/2001 |
| WO | 2014108398 | | 7/2014 |
| WO | 2015143171 | | 9/2015 |
| WO | 2015143171 | A1 | 9/2015 |
| WO | 2016036926 | | 3/2016 |

TRAVEL JOINT

BACKGROUND

This section is intended to provide information to facilitate a better understanding of the various aspects of the described embodiments. Accordingly, it should be understood that these statements are to be read in this light and not as admissions of prior art.

A travel joint may be used to deploy a downhole tool at a particular borehole depth using a tubular string, such as positioning an access window of the tool at a lateral branch of the borehole. The travel joint allows the tubular string to telescopically extend or contract, which in turn can raise or lower the downhole tool in the borehole or allow the downhole tool to remain in place while other portions of the tubular string move. A travel joint may be deployed from the surface in a collapsed position at a depth where a lateral branch is located in the borehole. The travel joint may then be released by any suitable release mechanism to selectively position the access window of the downhole tool at the location of the lateral branch.

Downhole tools may be operated using control lines mounted to the exterior of the tubular string, such as a production string or drill string. The control lines provide power or data communication paths to tools located in a wellbore, such as completion equipment or formation evaluation tools. The control lines can include hydraulic cables, fiber optic cables, or electric cables. When a telescoping travel joint or connection is used, the control lines may be wrapped around the exterior of the string to allow the control lines to contract or extend like a coil spring with the telescoping movements of the travel joint. This coil spring design for the control lines can introduce additional stress on the cables, increasing their risk of fatigue failure. In cases of hydraulic control lines, the cables may also have reduced pressure capabilities in a coil spring design. Moreover, the coil spring design prevents the travel joint from rotating without risk of damaging the control lines. Also, in cases where multiple control lines are wrapped around the mandrel, the nested control lines increase the risk of cables binding as the travel joints telescopically strokes.

BRIEF DESCRIPTION OF THE DRAWINGS

For a detailed description of the embodiments of the invention, reference will now be made to the accompanying drawings in which.

DETAILED DESCRIPTION

This disclosure provides one or more hydraulic control line communication paths through a travel joint. Specifically, the disclosure provides a travel joint that includes one or more cavities between a sleeve and piston, allowing hydraulic control line communication across the travel joint. The travel joint can include one or more cavities between a sleeve and a tubular piston to provide a path for hydraulic communication between the telescoping ends of the travel joint. These cavities allow the hydraulic control lines to be mounted to the travel joint without the coil spring design. Also, these cavities optionally allow the tubular piston to rotate within the sleeve of the travel joint.

Figure 1:
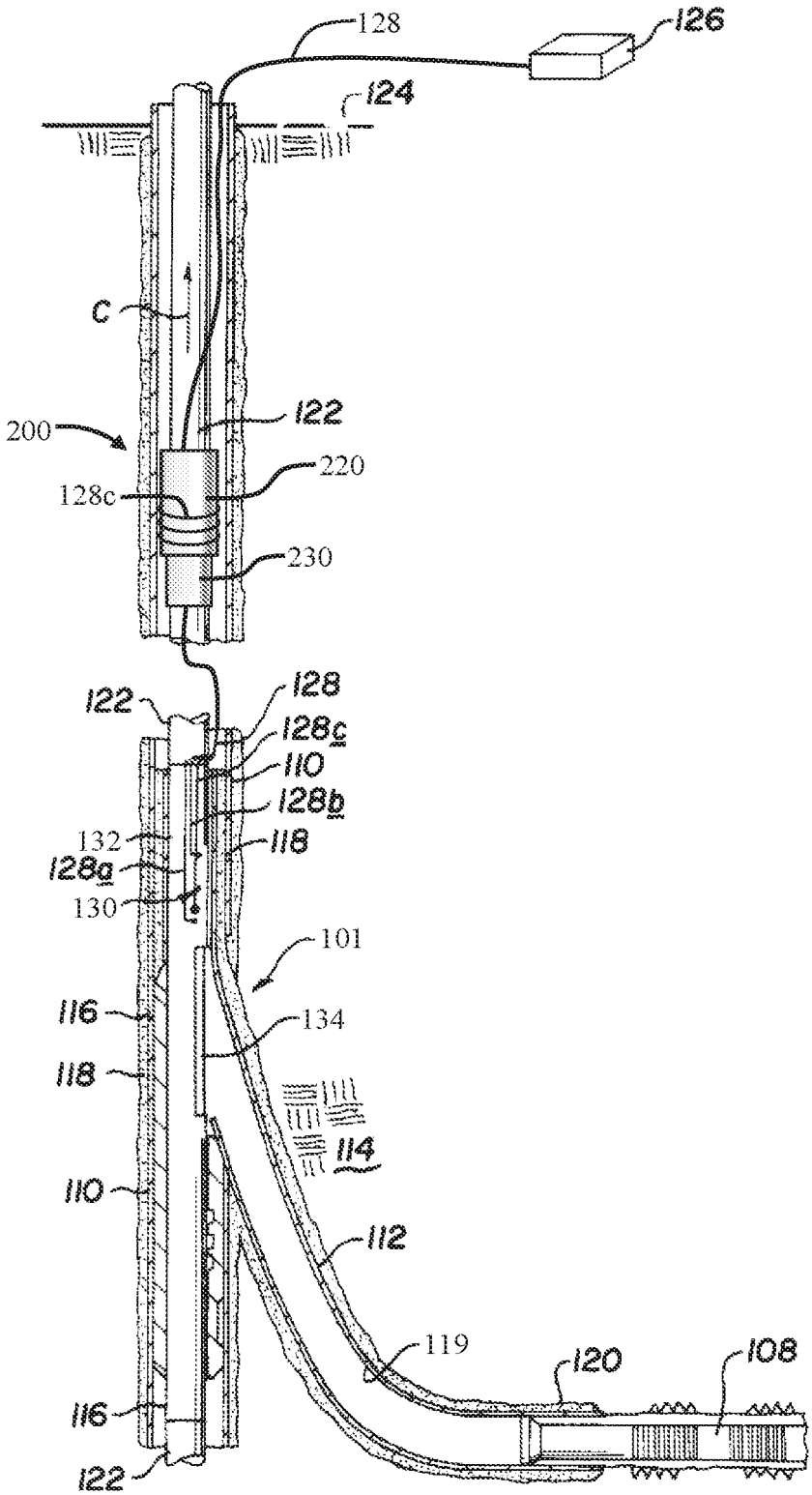
FIG. 1 is a cross-section schematic diagram of a well system with a travel joint deployed in a wellbore intersecting an earth formation, according to one or more embodiments.

FIG. 1 is a cross-sectional schematic view of a well system 100 with a remotely-controlled exit sleeve 130 deployed in a multilateral well 101 using a travel joint 200. The multilateral well 101 has a main wellbore 110 and at least one lateral wellbore 112. Also shown is a downhole completion assembly 108 extending into the lateral wellbore 112.

The main wellbore 110 and the lateral wellbore 112 have been drilled into the earth formation 114, which is generally referred to as material surrounding the wellbores. A main casing 116 is set into the main wellbore 110 with cement 118, using methods known to those skilled in the art. The lateral wellbore 112 has a lateral liner 119 set into the lateral wellbore 112 with lateral liner cement 120.

A carrier 122 is used to deploy a remote-controlled exit sleeve 130. As depicted, the carrier 122 is a tubing string. However, it should be appreciated that the carrier 122 may be any device suitable to convey the exit sleeve 130, travel joint 200, or other downhole tool or device. For example, the carrier 122 may include, but is not limited to, rigid and non-rigid carriers, production tubing, coiled tubing, casing, liners, drill pipe, wirelines, tubulars, etc.

The exit sleeve 130 includes a body 132 with an exit-window sleeve 134. Shown in FIG. 1, the exit window sleeve 134 is in a closed position to block access from the inner bore of the carrier 122 to the inner bore of the lateral liner 119. The exit-window sleeve 134 is remote-controlled from the surface 124 by a control system 126, which can include control valves, a power source (such as a pump), and a fluid reservoir. The control system 126 is coupled with an electro-hydraulic downhole completion system that can be manipulated to modify the flow profile of the multilateral well 100.

A control line 128 couples the control system 126 to the exit sleeve 130 such that the exit sleeve 130 is responsive to commands transmitted from the control system 126. The control line 128 can be a dual-redundant umbilical line, each line having a return hydraulic control line 128*a* and an input hydraulic control line 128*b*, and a non-hydraulic control line 128*c*. It should be noted, however, that other communication and power systems may be used to service and control the exit sleeve 130. For example, electromagnetic transmission techniques or acoustic transmission techniques, which are known to those skilled in the art, can be used to control the exit sleeve 130 in combination with an uphole or downhole power supplies.

The hydraulic control lines 128*a* and 128*b* provide a conduit for applying pressure from the surface 124 to the exit sleeve 130 to exert a hydraulically-generated pressure differential force to operate the exit sleeve 130. The control line 128 may include one or more non-hydraulic control lines 128*c* (e.g., electric cables, fiber optic cables, or any other suitable control line except hydraulic control lines) mounted on the travel joint 200 in a spring-coil configuration. The non-hydraulic control line 128*c* can be used to carry commands from the control system 126 to the exit sleeve 130 via fiber optic or electromagnetic signals.

The travel joint 200 may be coupled to the carrier 122 above the exit sleeve 130 to allow for an accurate deployment of the exit sleeve 130 at particular location in the wellbore 110. Further, the travel joint 200 may be communicatively coupled between the control system 126 and the exit sleeve 130 to provide a hydraulic communication path through the travel joint 200 without using the spring-coil design.

In one or more embodiments, the travel joint 200 includes a sleeve assembly 220 and a piston assembly 230 that telescopically extends and contracts to accurately deploy the exit sleeve 130 at a particular wellbore location, such as the junction where the main wellbore 110 meets the lateral wellbore 112. The exit sleeve 130 is hydraulically coupled to the hydraulic control lines 128*a* and 128*b* through one or more cavities located on the travel joint 200 between the sleeve assembly 220 and the piston assembly 230, as described in more detail below.

It will be appreciated that the exit sleeve 130 is an exemplary downhole tool that can be deployed in the wellbore 110 with the travel joint 200. In one or more embodiments, the travel joint 200 may be used to accurately position other downhole tools in the wellbore 110. These other downhole tools may include, but are not limited to, multilateral completion systems, multilateral exit systems, multilateral workover tools, completion equipment, formation evaluation tools, etc. The travel joint 200 may also be used in offshore drilling systems where movement in the carrier 122 above the travel joint 200 (such as movement caused by sea currents and/or waves) needs to be compensated to keep the carrier 122 below the travel joint 200 in a suitable position.

Figure 2:
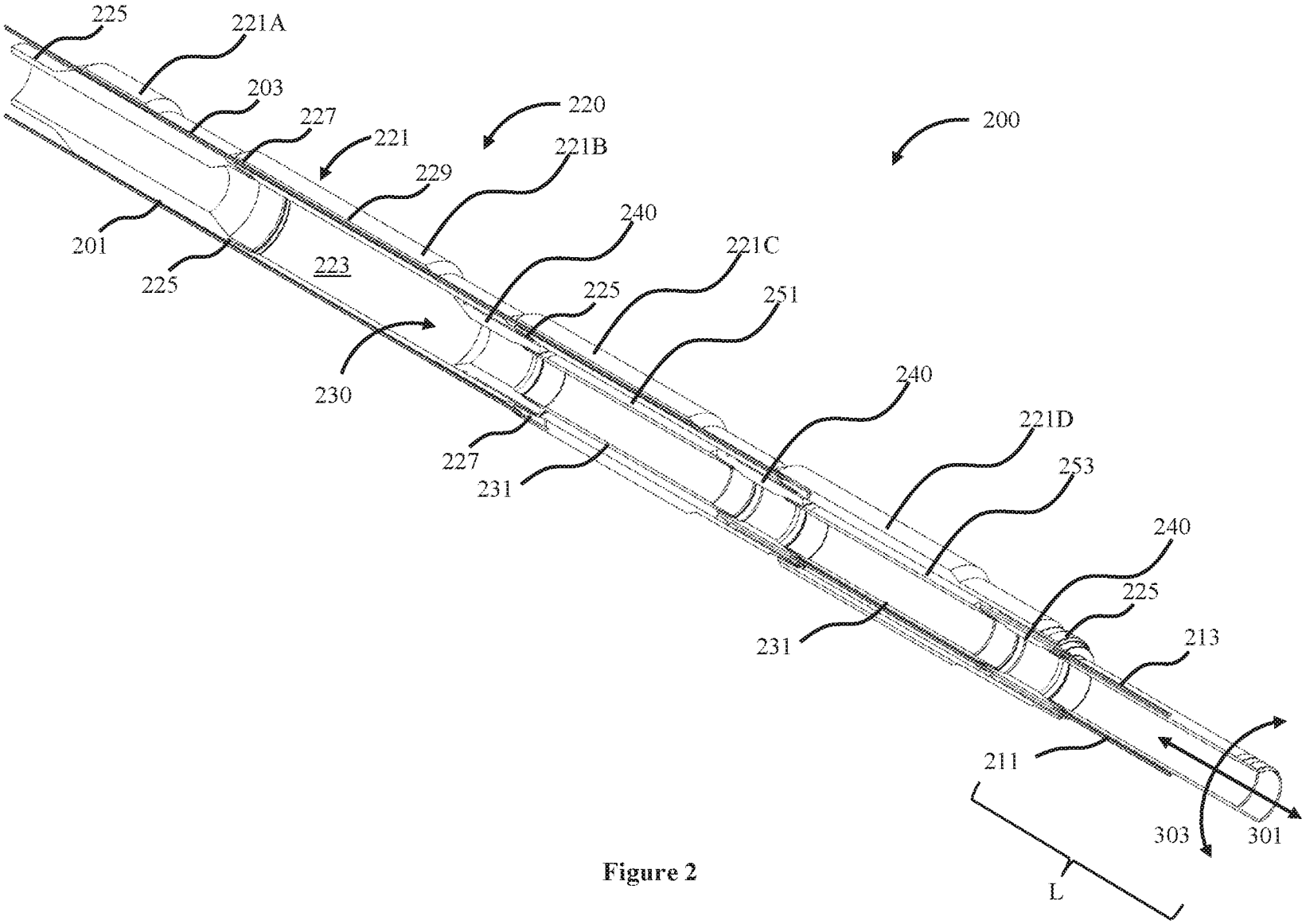
FIG. 2 is a sectioned isometric view of the travel joint of FIG. 1, according to one or more embodiments.
Figure 3A:
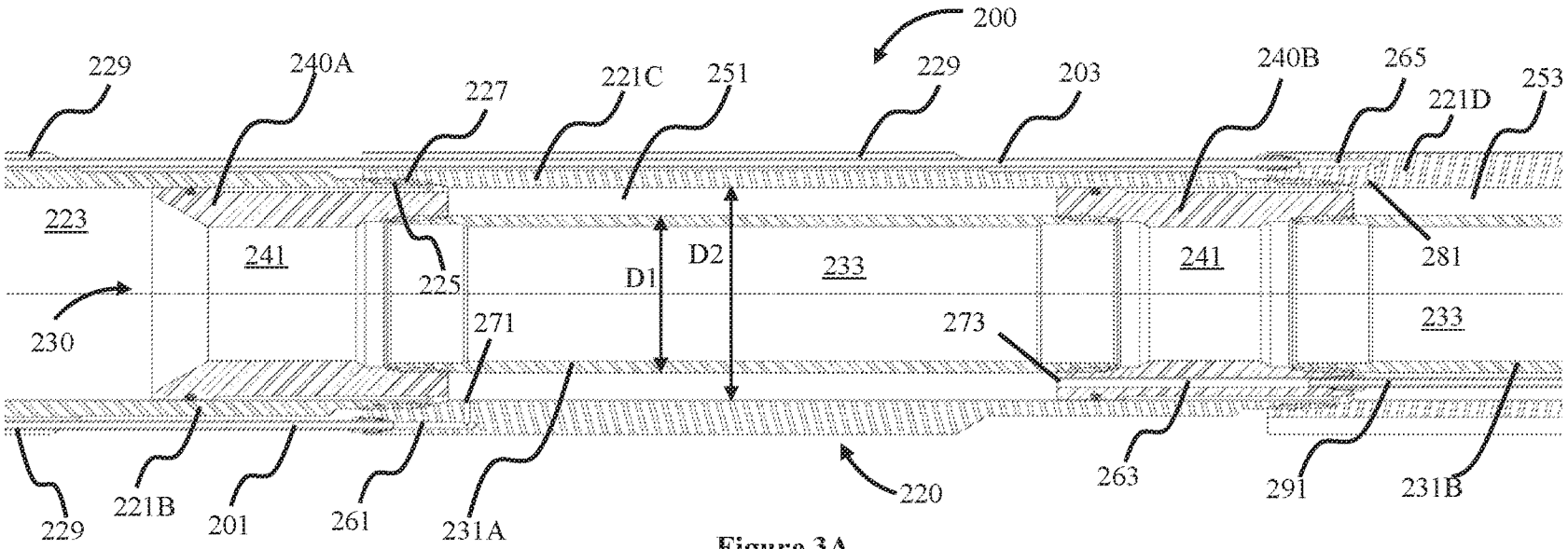
FIGS. 3A-C are section views of the travel joint of FIG. 1, according to one or more embodiments.
Figure 3B:
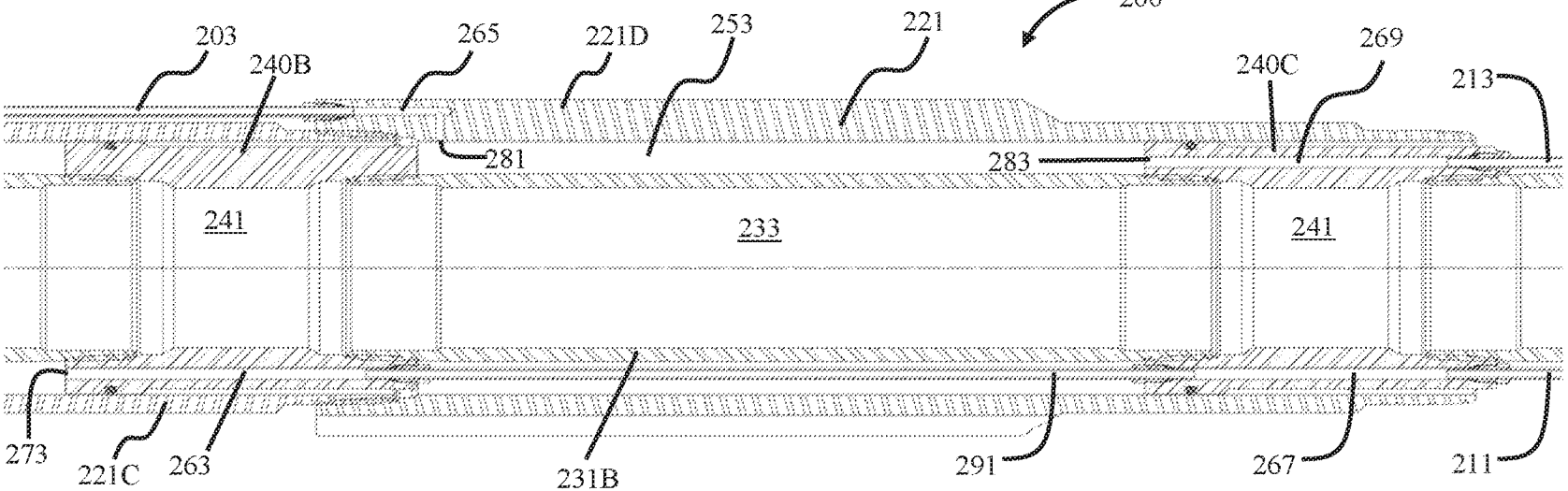
Figure 3C:
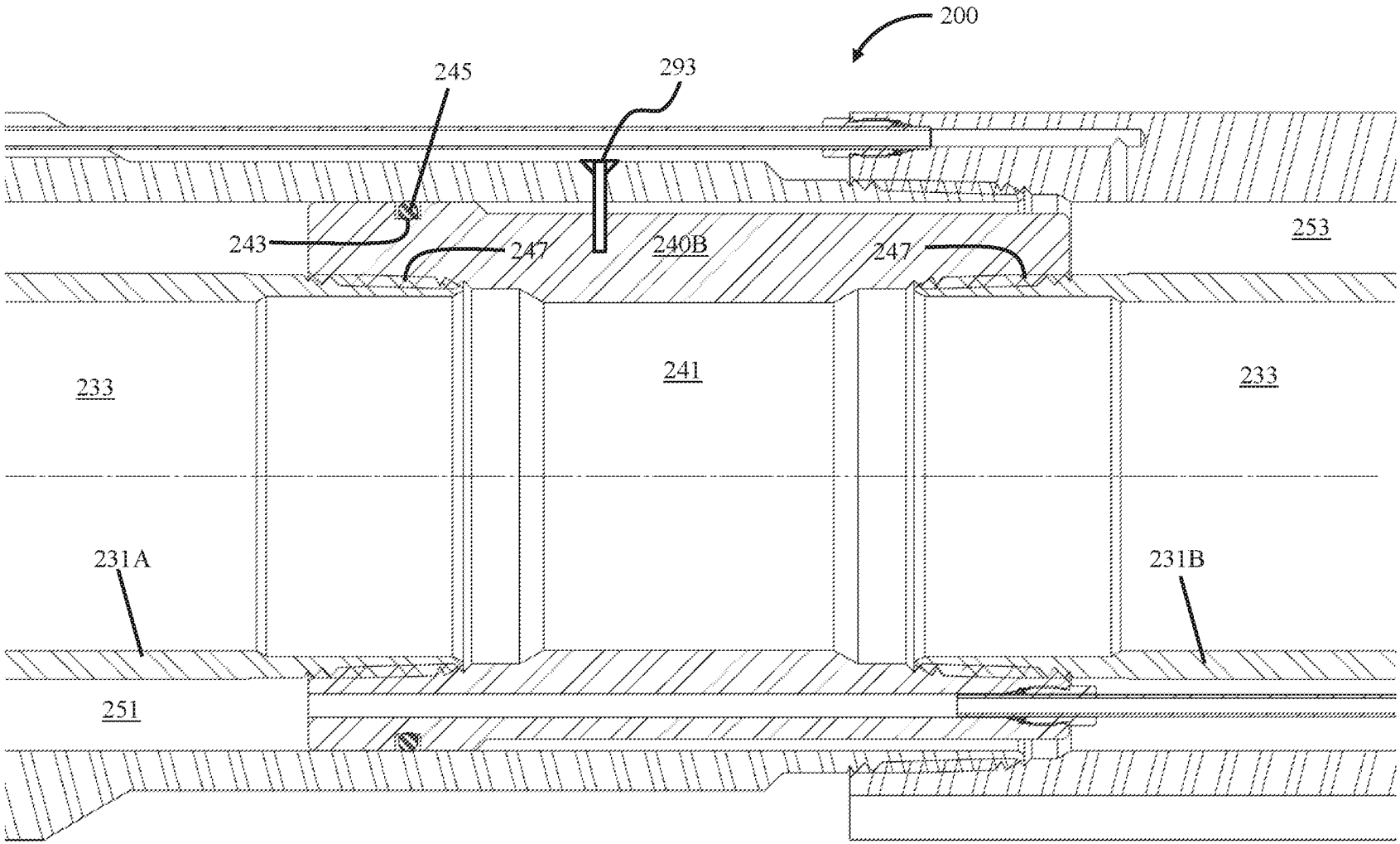

FIGS. 2-3C depict sectioned views of the travel joint 200 of FIG. 1, in accordance with one or more embodiments. As shown, the travel joint 200 includes a sleeve assembly 220 and a piston assembly 230. The hydraulic control lines 201, 203, 211, and 213 can be in fluid communication with the travel joint 200 through the annular cavities 251 and 253. In certain embodiments, the annular cavity 253 is isolated from hydraulic communication with the annular cavity 251.

As show in FIG. 2, the piston assembly 230 is telescopically moveable within and relative to the sleeve assembly 220 in the axial directions indicated by arrow 301. The piston assembly 230 can also rotate within and relative to the sleeve assembly 220 in the angular directions indicated by arrow 303. The sleeve assembly 220 includes a tubular housing 221 including a sleeve bore 223 for receiving the piston assembly 230, allowing the piston assembly 230 to telescopically stroke in and out of the sleeve assembly 220. The housing 221 of the sleeve assembly 220 can include one or more housing modules 221A-221D coupled together (e.g., via threads 225, 227) to provide modular expansion or reduction of the hydraulic control lines communicated through the travel joint 200 and/or modular expansion or reduction of the stroke length L of the travel joint 200. As used herein, the stroke length L refers to the distance that the piston assembly 230 travels from a contracted positioned where it is fully contracted in the sleeve assembly 220 to extended position where the piston assembly 230 is fully extended from the sleeve assembly 230. The housing modules 221A-221D can include a female threaded portion 225 and a male threaded portion 227 to couple to each other. For example, the housing module 221B has a male threaded portion 227 that couples with the female threaded portion 225 of housing module 221A. Additionally, the housing module 221B has a female threaded portion 225 that couples with the male threaded portion 227 of housing module 221C. Further, the housing modules 221A and 221D include female threaded portions 225 to couple with the carrier 122 or other downhole tools, e.g., the exit sleeve 130. In embodiments, the hydraulic control lines 201 and 203 can be run through channels 229 in the housing modules 221A-221C to at least partially secure the hydraulic control lines 201 and 203 to the sleeve assembly 220. The sleeve bore 223 allows drilling fluid, production fluid, or any other suitable fluid to flow through the travel joint 200 that may be flowing in the carrier 122 of FIG. 1.

The piston assembly 230 includes piston housings 231 coupled to dividers 240. The outer dimension D1 of the piston housings 231 is smaller than the inner dimension D2 of the sleeve assembly housing 221, thus defining annular cavities 251, 253 between the sleeve assembly 220 and the piston assembly 230. In one or more embodiments, the piston assembly 230 may optionally include a unified body (not shown) such that the annular cavities are defined without separate dividers 240 coupled to the body of the piston assembly 130. Thus, the dividers 240 may be integral with the piston assembly 230.

The upper hydraulic control lines 201, 203 can be hydraulically coupled to one or more downhole tools positioned uphole from the travel joint 200 or surface equipment, such as the control system 126. The lower hydraulic control lines 211, 213 can be hydraulically coupled to one or more downhole tools (e.g., the exit sleeve 130) positioned downhole from the travel joint 200 in the wellbore. Hydraulic control signals can be communicated either way through the travel joint 200 from either the control system 126 (FIG. 1) or a downhole tool in the wellbore positioned uphole from the travel joint 200, allowing bi-directional hydraulic communication. For example, the hydraulic control signals can travel to downhole tools (such as the exit sleeve 130) positioned downhole from the travel joint 100. The travel joint 200 can also include one or more non-hydraulic control lines 128*c* from FIG. 1 (e.g., electric control lines, fiber optic control lines, or any other suitable control line, cable, or wire) mounted to the sleeve assembly 220 and/or the piston assembly 230.

FIGS. 3A-C are more detailed cross-sectional views of the travel joint 200 illustrated in FIGS. 1 and 2, according to one or more embodiments. The piston assembly 230 includes piston housings 231 (231A, 231B) coupled to the dividers 240 (240A, 240B, 240C) to form a common piston bore 233 to allow fluid to flow from the sleeve bore 223 through the travel joint 200. The annular cavity 251 can be further defined as surrounding the housing 231A between the dividers 240A and 240B. Optionally or additionally, the annular cavity 253 can be further defined as surrounding the housing 231B between the dividers 240B and 240C.

The fluid communication through each of the hydraulic control lines will now be discussed. As discussed above, the upper hydraulic control line 201 is hydraulically coupled to the lower hydraulic control line 211 through the travel joint 200. For convenience, fluid communication from the upper hydraulic control line 201 to the lower hydraulic control line 211 will be discussed. It should be appreciated that communication may occur in the reverse direction as well. From the upper hydraulic control line 201, fluid is communicated to a passage 261 and a port 271 in the sleeve assembly housing 221. The passage 261 is configured to hydraulically couple the upper control line 201 to the annular cavity 251. The divider 240A is sealed against the inside of the sleeve assembly housing 221, thus preventing fluid in the cavity 251 from flowing across the divider 240A. The divider 240B, which is between the annular cavities 251 and 253, includes a port 273 and a passage 263 configured to hydraulically couple to a conduit 291 providing fluid communication between the annular cavity 251 and the conduit 291. The divider 240C (in FIG. 3B) includes a passage 267 configured to hydraulically couple the conduit 291 to the lower control line 211. The conduit 291 extends through, but is hydraulically isolated from, the annular cavity 253, thus isolating the conduit 291 from the fluid in the annular cavity 253. In one or more embodiments, the conduit 291 can include a steel alloy tubular that is hydraulically coupled between the passages 263 and 267 on the respective dividers 240B, 240C. The upper control line 201 is thus in hydraulic communication with the lower control line 211 through the annular cavity 251 and across the travel joint 200 while allowing for the piston assembly 230 to stroke within the sleeve assembly 220.

As discussed above, the upper hydraulic control line 203 is hydraulically coupled to the lower hydraulic control line 213 through the travel joint 200. For convenience, fluid communication from the upper hydraulic control line 203 to the lower hydraulic control line 213 will be discussed. It should be appreciated that communication may occur in the reverse direction from the lower hydraulic control line 213 to the upper hydraulic control line 203 as well. The hydraulic control line 203 can run through a channel 229 in the housing module 221C to at least partially secure the hydraulic control line 203 to the sleeve assembly 220. From the upper hydraulic control line 201, fluid is communicated to a passage 265 and a port 281 in the sleeve assembly housing 221. The passage 265 is configured to hydraulically couple the upper control line 203 to the annular cavity 253. The divider 240B is sealed against the inside of the sleeve assembly housing 221, thus preventing fluid in the cavity 253 from flowing across the divider 240B. The divider 240C (in FIG. 4) includes a port 283 and a passage 269 configured to hydraulically couple the annular cavity 253 to the lower control line 213. The upper control line 203 is in hydraulic communication with the lower control line 213 through the annular cavity 253 and across the travel joint 200 while allowing for the piston assembly 230 to stroke within the sleeve assembly 220.

The annular cavities 251 and 253 can provide isolated communication paths for hydraulic control signals across the travel joint 200. Hydraulic control signals can be communicated across the travel joint 200 through the annular cavity 251 without communicating through the annular cavity 253. In certain embodiments, the annular cavity 251 can be employed as an input communication path, while the annular cavity 253 can be employed as a return communication path.

Referring to FIG. 3C, the divider 240B, which is between the annular cavities 251 and 253, is illustrative of the dividers 240A, 240C. In particular, the divider 240B can include one or more annular recesses 243 for receiving one or more seals 245 (e.g., an O-ring seal) to prevent fluid from communicating between the sleeve assembly 220 and piston assembly 230. The divider 240B includes threads 247 that mate with the piston housings 231A, 231B. The threads 247 maintain the pressure integrity of the tubular string (e.g., carrier 122, production tubing, etc.) and the annular cavities 251, 253. In one or more embodiments, seals may also be coupled between the piston housing 231A, 231B and the divider 240B to maintain pressure integrity. The travel joint 200 can also optionally include one or more releasable fasteners 293 (e.g., shear pins, collet, J-Slots, metered hydraulic time releases, or any other suitable latching mechanism) to selectively position the piston assembly 230 in the sleeve assembly 220. That is, the travel joint 200 can include a fastener 293 to hold the travel joint 200 in a desired extended, collapsed, or partially extended position, until it is ready to stroke the travel joint 200 (e.g., deploying the exit sleeve 130 at a multilateral branch as depicted in FIG. 1). The fastener 293 can include one or more shear pins that hold the travel joint 200 in the desired position, until a pre-determined force is applied to the shear pins. As non-limiting examples, the shear pins can be sheared from the pre-determined force applied by either (a) a piston operated by an additional hydraulic control line fed to the travel joint 200 from the surface, or (b) the contraction force or extension force of the piston assembly 230. As illustrated in FIG. 5, the fastener 293 can include a shear pin coupling the piston assembly 230 to the sleeve assembly 220 and positioned on the divider 240B. In other examples, the fastener 293 can include a collet that disengages or reengages the piston assembly 230 to a desired position in the sleeve assembly 220. Thus, the position of a downhole tool (such as the exit sleeve 130) in a wellbore and coupled to the travel joint 200 can be adjusted by selectively contracting or extending the travel joint 200.

The piston assembly 230 can telescopically contract or extend relative to the sleeve assembly 220, while maintaining fluid communication between the respective hydraulic control lines 201, 203, 211, and 213. The passage 261 may be positioned on the sleeve assembly housing 221 to provide continuous fluid communication between the hydraulic control line 201 and the annular cavity 251 throughout the stroke of the piston assembly 230. The annular cavities 251 and 253 are in fluid communication with the sleeve assembly 220 and the piston assembly 230 such that the passages 261 and 267 are in fluid communication through the annular cavity 251 and/or the passages 265 and 269 are in fluid communication through the annular cavity 253. Further, the passage 265 can be positioned on the sleeve assembly housing 221 to provide continuous fluid communication between the hydraulic control line 203 and the annular cavity 253 throughout the stroke of the piston assembly 230. The hydraulic control lines 211, 213 can be coupled to the divider 240C at the passages 267 and 269 to provide fixed mounting points that allow the hydraulic control lines 211, 213 to stroke with the piston assembly 230.

As shown, the annular cavities 251, 253 are hydraulically isolated from each other and the environment outside the travel joint 200 by the dividers 240A, B, C. The cavities 251, 253 can have fixed volumes, preventing the pressure in the control lines 201, 203, 211, and 213 from changing as the travel joint 200 strokes. Although shown with two separate control lines and two separate cavities, the travel joint 200 can include a single cavity between the sleeve assembly 220 and the piston assembly 230 to provide hydraulic communication between the control lines 201 and 211.

Figure 4:
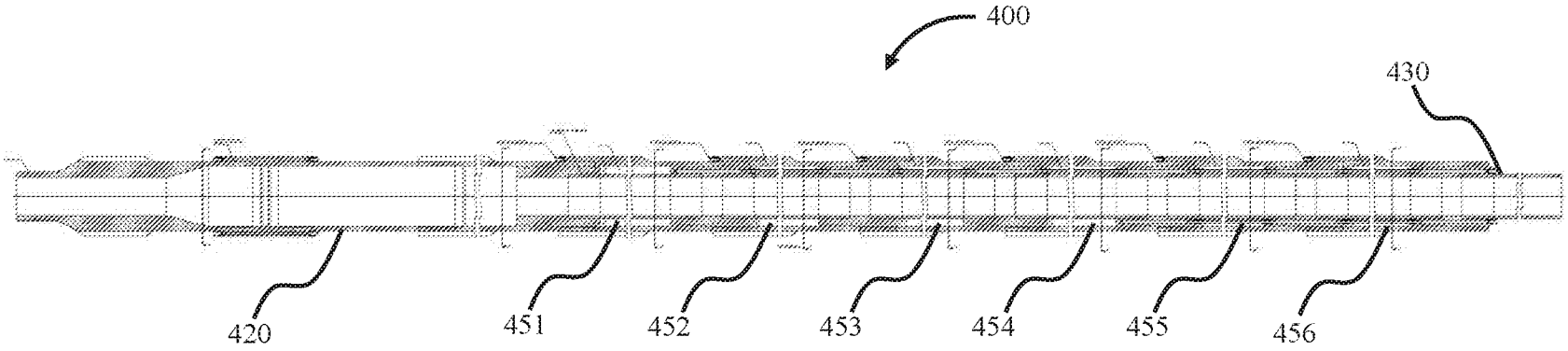
FIG. 4 is a cross-section view of a travel joint with six annular cavities, according to one or more embodiments.

In one or more embodiments, the travel joint 200 may have two or more annular cavities to provide additional hydraulic communication paths that do not require a spring-coil mounting mechanism on the sleeve assembly 220 and/or the piston assembly 230. FIG. 4 depicts a cross-section view of a travel joint 400 in accordance with one or more embodiments. As shown, the travel joint 400 includes six annular cavities 451-456, according to one or more embodiments. The travel joint 400 can include six cavities 451-456 to provide hydraulic communication paths between six upper control lines hydraulically coupled to the sleeve assembly 420 and six lower control lines hydraulically coupled to the piston assembly 430.

Figure 5A:
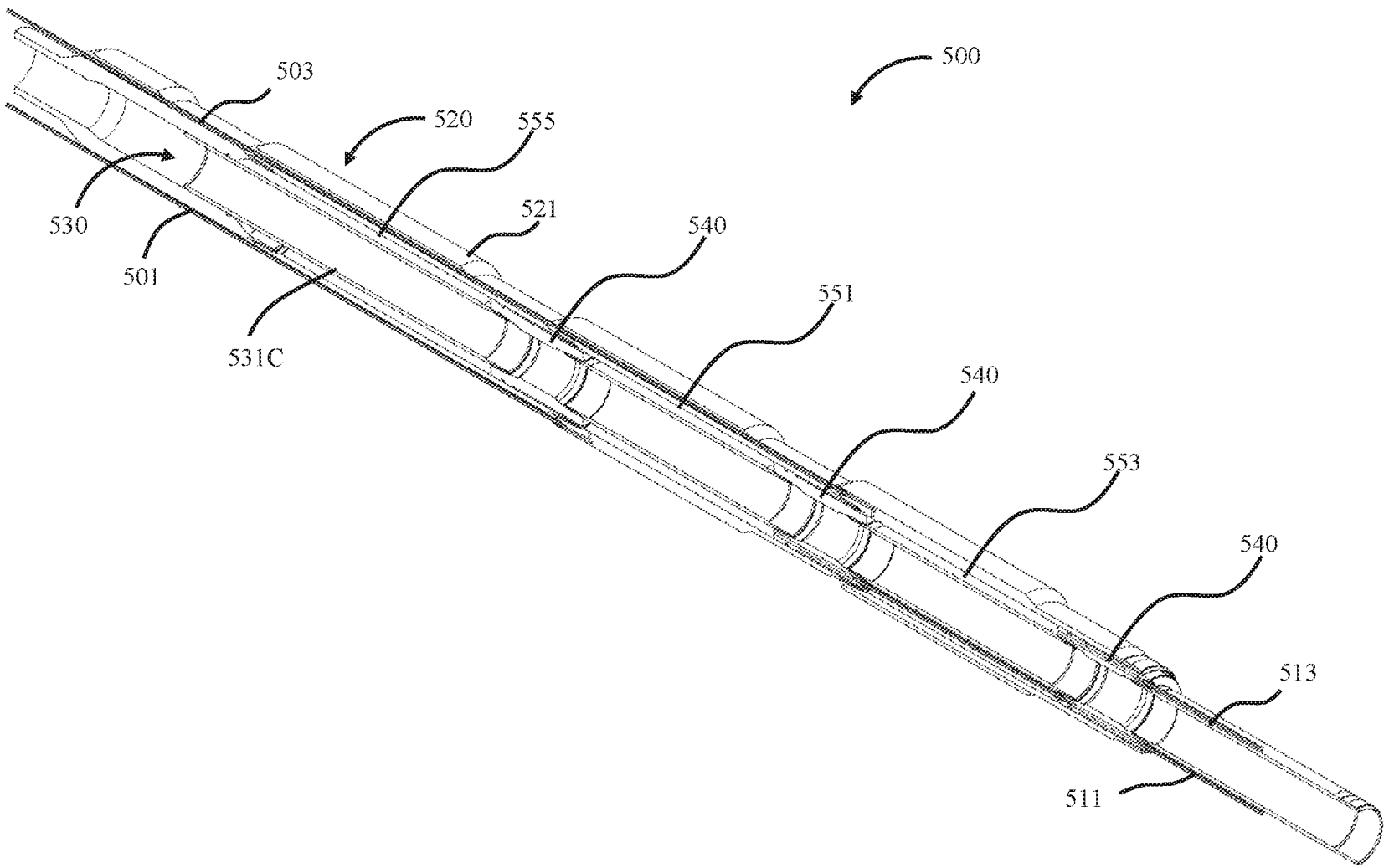
FIGS. 5A and 5B are sectioned views of a travel joint that is pressure balanced, according to one or more embodiments.
Figure 5B:
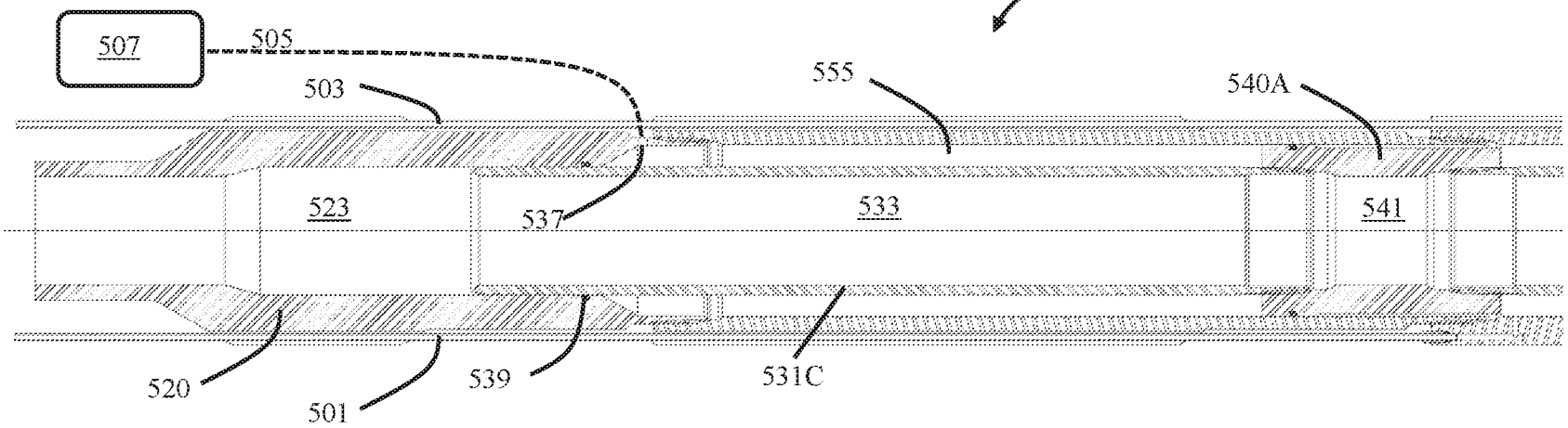

As shown, the travel joint 200 is not pressure balanced from the fluid within the tubular string (e.g., production string, drill string, or coiled tubing) through the bores 223, 233, 241. Pressure differentials applied to fluid inside of the bores 223, 233, 241 can cause the travel joint 200 to contract or extend. Pressure balancing the travel joint 200 can prevent it from stroking when there are changes in pressure in the bores 223, 233, 241. FIGS. 5A and 5B depict cross-sectional views of a travel joint 500, in accordance with one or more embodiments which is pressure balanced from the fluid within the bores 523, 533, 541. As shown, the piston assembly 530 includes an additional piston housing 531C that isolates the piston assembly 530 from the internal pressure of the fluid (e.g., production fluid or drilling fluid) within the tubular string in fluid communication with the travel joint 500. The sleeve bore 523 slidably receives the piston housing 531C and couples to the piston housing 531C through the extent of the stroke of the piston assembly 530. The sleeve assembly 520 includes a seal 539 coupled to the piston housing 531C to prevent fluid from communicating between the sleeve assembly 520 and piston assembly 530. An additional annular cavity 555 is formed between the sleeve assembly 520 and piston housing 531C. The annular cavity 555 is isolated from fluid communication with the annular cavities 551 and 553. The annular cavity 555 includes a sleeve passage 537 allowing fluid within the cavity 555 to flow in and out of the travel joint 500.

Optionally, the travel joint 500 includes an additional hydraulic control line 505 in fluid communication with the annular cavity 555 through the sleeve passage 537. The annular cavity 555 can be configured to stroke the piston assembly 530 relative to the sleeve assembly 520 by filling fluid into or draining fluid from the annular cavity 555. The sleeve passage 537 can be configured to couple with the hydraulic control line 505 to provide fluid communication path to the annular cavity 555. A bi-directional hydraulic power source 507, such as a hydraulic pump, with control valves positioned uphole can cab coupled to the hydraulic control line 505 and control the flow of fluid in or out of the annular cavity 555, causing the piston assembly 530 to extend or contract from the sleeve assembly 520.

Figure 6A:
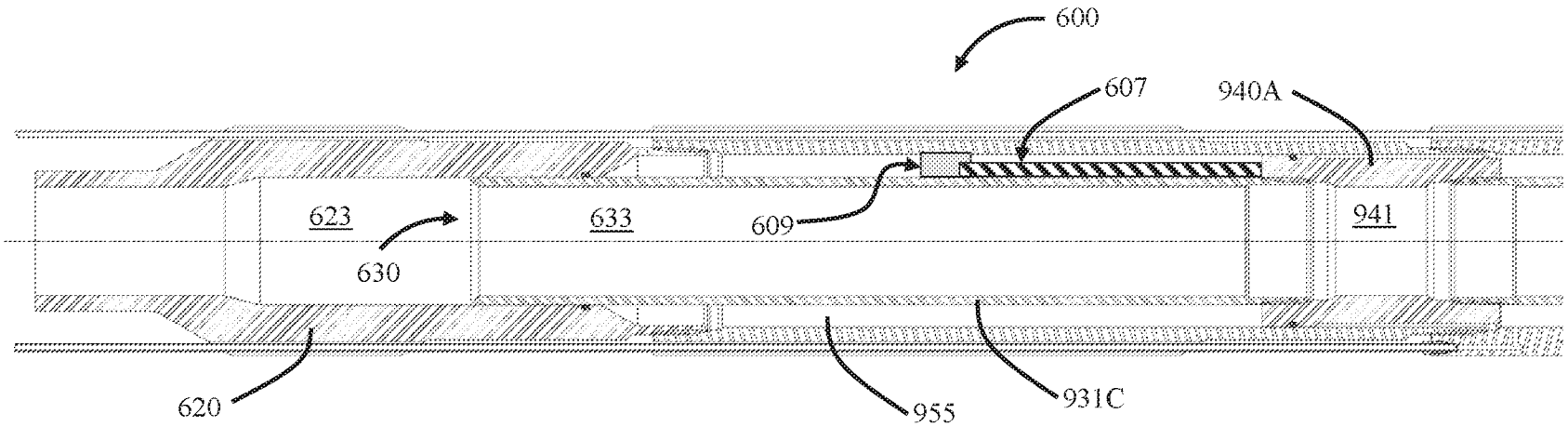
FIGS. 6A and 6B are cross-section views of a travel joint that includes splines and uses a control line to contract or extend a piston assembly, according to one or more embodiments.
Figure 6B:
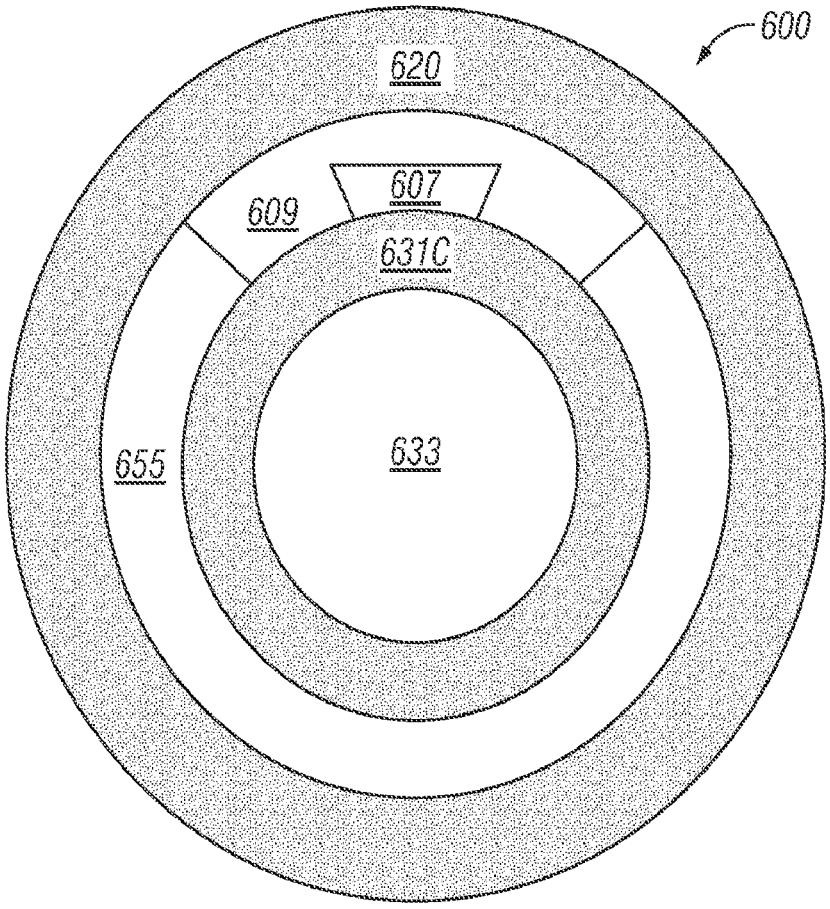

In one or more embodiments, the travel joint may include a mechanism to prevent the piston assembly from rotating relative to the sleeve assembly. FIGS. 6A and 6B depict a travel joint 600 configured to control the stroke of the piston assembly 630 and to prevent the piston assembly 630 from rotating within the sleeve assembly 920, according to one or more embodiments.

As shown, the travel joint 600 includes one or more splines 607 that fit within respective grooves or channels 609. The groove 609 allows the spline 607, and thus the piston assembly 630 to move axially, but prevents the spline 607 and thus the piston assembly 630 from rotating within the sleeve assembly 620. In particular, the groove 609 can receive the spline 607 on the piston assembly 630. The spline 607 may be positioned on at least a portion of the housing 631C as depicted in FIG. 6A. In one or more embodiments, the sleeve assembly 620 can include one or more grooves 609, and, likewise, the piston assembly 630 can include one or more mateable splines 607. It should be appreciated that the travel joint 600 can also include any other suitable mechanism configured to allow axial movement and prevent rotational movement between the piston assembly 630 and the sleeve assembly 620.

In addition to the embodiments described above, many examples of specific combinations are within the scope of the disclosure, some of which are detailed below:

Example 1

A travel joint assembly for hydraulic communication between a first and second hydraulic line, comprising:

a sleeve assembly comprising a sleeve passage configured to hydraulically couple to the first hydraulic line;

a piston assembly telescopically moveable within the sleeve assembly and comprising a piston passage configured to hydraulically couple to the second hydraulic line; and an annular cavity between the piston assembly and the sleeve assembly and in fluid communication with the sleeve assembly and the piston assembly such that the sleeve and piston passages are in fluid communication through the annular cavity.

Example 2

The travel joint assembly of example 1, wherein the piston assembly is rotatable within the sleeve assembly.

Example 3

The travel joint assembly of example 1, wherein the piston assembly comprises:

two dividers; and a housing coupled between the two dividers; and wherein the annular cavity is further defined as surrounding the housing between the dividers.

Example 4

The travel joint assembly of example 1, further comprising an additional annular cavity between the piston assembly and the sleeve assembly.

Example 5

The travel joint assembly of example 4, further comprising a vent between the additional annular cavity and the sleeve assembly, wherein the additional annular cavity is pressure balanced to prevent fluid pressure in the sleeve assembly from moving the piston assembly relative to the sleeve assembly.

Example 6

The travel joint assembly of example 1 for additional hydraulic communication between a third and fourth hydraulic line, further comprising:

an additional annular cavity isolated from fluid communication with the annular cavity;

an additional sleeve passage configured to hydraulically couple to the third hydraulic line;

an additional piston passage configured to hydraulically couple to the fourth hydraulic line; and wherein the additional sleeve passage and additional piston passage are in fluid communication through the additional annular cavity.

Example 7

The travel joint assembly of example 6, wherein the third hydraulic control line and the fourth hydraulic control line are hydraulically isolated from the annular cavity.

Example 8

The travel joint assembly of example 1 for additional hydraulic communication between additional hydraulic lines, further comprising additional annular cavities isolated from fluid communication between the cavities.

Example 9

The travel joint assembly of example 1, further comprising a releasable fastener to position the piston assembly in the sleeve assembly.

Example 10

The travel joint assembly of example 1, further comprising:

an additional annular cavity isolated from fluid communication with the annular cavity and configured to stroke the piston assembly;

an additional sleeve passage in fluid communication with the additional annular cavity configured to hydraulically couple with a third hydraulic line.

Example 11

The travel joint assembly of example 1, further comprising a mechanism configured to allow axial movement and prevent rotational movement between the sleeve assembly and the piston assembly.

Example 12

A system for communicating hydraulic control signals through a travel joint for hydraulic communication between a first and second hydraulic line, comprising:

a travel joint comprising:

a sleeve assembly comprising a sleeve passage configured to hydraulically couple to the first hydraulic line;

a piston assembly telescopically moveable within the sleeve assembly and comprising a piston passage configured to hydraulically couple to the second hydraulic line;

an annular cavity between the piston assembly and the sleeve assembly in fluid communication with the sleeve assembly and the piston assembly such that the sleeve and piston passages are in fluid communication through the annular cavity; and a downhole tool coupled to the piston assembly of the travel joint and in fluid communication with the second hydraulic line.

Example 13

The system of example 12, wherein the piston assembly is rotatable within the sleeve assembly.

Example 14

The system of example 12, wherein the piston assembly comprises:

two dividers; and a housing coupled between the two dividers; and wherein the annular cavity is further defined as surrounding the housing between the dividers.

Example 15

The system of example 12, further comprising:

an additional annular cavity isolated from fluid communication with the annular cavity;

an additional sleeve passage hydraulically coupleable with a third hydraulic line;

an additional piston passage hydraulically coupleable with a fourth hydraulic line; and wherein the additional sleeve passage and the additional piston passage are in fluid communication through the additional annular cavity.

Example 16

A method of controlling a downhole tool by communicating hydraulic control signals through a travel joint, comprising:

telescopically coupling a piston assembly in a sleeve assembly to form an annular cavity between the piston assembly and the sleeve assembly;

coupling a hydraulic line to the annular cavity from a side of the travel joint;

coupling another hydraulic line to the annular cavity from the other side of the travel joint; and communicating hydraulic control signals to the downhole tool through the hydraulic lines through the annular cavity.

Example 17

The method of example 16, further comprising axially moving the piston assembly relative to the sleeve assembly.

Example 18

The method of example 16, further comprising rotating the piston assembly relative to the sleeve assembly.

Example 19

The method example 16, further comprising:

forming an additional annular cavity between the piston assembly and the sleeve assembly;

communicating hydraulic control signals across the travel joint through the additional annular cavity without communicating through the annular cavity.

Example 20

The method of example 17, wherein axially moving the piston assembly comprises releasing a releasable fastener coupled to the piston assembly.

This discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

What is claimed is:

1. A travel joint assembly for hydraulic communication between a first and second hydraulic line, comprising:

a sleeve assembly comprising a sleeve passage configured to hydraulically couple to the first hydraulic line;

a piston assembly telescopically moveable within the sleeve assembly and comprising a piston passage configured to hydraulically couple to the second hydraulic line, the piston assembly comprising:

two dividers; and a housing coupled between the two dividers; and an annular cavity between the piston assembly and the sleeve assembly and in fluid communication with the sleeve assembly and the piston assembly such that the sleeve and piston passages are in fluid communication through the annular cavity, wherein the annular cavity is further defined as surrounding the housing between the dividers.

2. The travel joint assembly of claim 1, wherein the piston assembly is rotatable within the sleeve assembly.

3. The travel joint assembly of claim 1, further comprising an additional annular cavity between the piston assembly and the sleeve assembly.

4. The travel joint assembly of claim 3, further comprising a vent between the additional annular cavity and the sleeve assembly, wherein the additional annular cavity is pressure balanced to prevent fluid pressure in the sleeve assembly from moving the piston assembly relative to the sleeve assembly.

5. The travel joint assembly of claim 1 for additional hydraulic communication between a third and fourth hydraulic line, further comprising:

an additional annular cavity isolated from fluid communication with the annular cavity;

an additional sleeve passage configured to hydraulically couple to the third hydraulic line; an additional piston passage configured to hydraulically couple to the fourth hydraulic line; and wherein the additional sleeve passage and additional piston passage are in fluid communication through the additional annular cavity.

6. The travel joint assembly of claim 5, wherein the third hydraulic control line and the fourth hydraulic control line are hydraulically isolated from the annular cavity.

7. The travel joint assembly of claim 1 for additional hydraulic communication between additional hydraulic lines, further comprising additional annular cavities isolated from fluid communication between the cavities.

8. The travel joint assembly of claim 1, further comprising a releasable fastener to position the piston assembly in the sleeve assembly.

9. The travel joint assembly of claim 1, further comprising: an additional annular cavity isolated from fluid communication with the annular cavity and configured to stroke the piston assembly; an additional sleeve passage in fluid communication with the additional annular cavity configured to hydraulically couple with a third hydraulic line.

10. The travel joint assembly of claim 1, further comprising a mechanism configured to allow axial movement and prevent rotational movement between the sleeve assembly and the piston assembly.

11. A system for communicating hydraulic control signals through a travel joint for hydraulic communication between a first and second hydraulic line, comprising:

a travel joint comprising: a sleeve assembly comprising a sleeve passage configured to hydraulically couple to the first hydraulic line;

a piston assembly telescopically moveable within the sleeve assembly and comprising a piston passage configured to hydraulically couple to the second hydraulic line, the piston assembly comprising:

two dividers; and a housing coupled between the two dividers;

an annular cavity between the piston assembly and the sleeve assembly in fluid communication with the sleeve assembly and the piston assembly such that the sleeve and piston passages are in fluid communication through the annular cavity, wherein the annular cavity is further defined as surrounding the housing between the dividers; and a downhole tool coupled to the piston assembly of the travel joint and in fluid communication with the second hydraulic line.

12. The system of claim 11, wherein the piston assembly is rotatable within the sleeve assembly.

13. The system of claim 11, further comprising:

an additional annular cavity isolated from fluid communication with the annular cavity;

an additional sleeve passage hydraulically coupleable with a third hydraulic line;

an additional piston passage hydraulically coupleable with a fourth hydraulic line; and wherein the additional sleeve passage and the additional piston passage are in fluid communication through the additional annular cavity.

14. A method of controlling a downhole tool by communicating hydraulic control signals through a travel joint, comprising:

telescopically coupling a piston assembly in a sleeve assembly to form an annular cavity between the piston assembly and the sleeve assembly;

coupling a hydraulic line to the annular cavity from a side of the travel joint; coupling another hydraulic line to the annular cavity from the other side of the travel joint;

communicating hydraulic control signals to the downhole tool through the hydraulic lines through the annular cavity;

forming an additional annular cavity between the piston assembly and the sleeve assembly; and communicating hydraulic control signals across the travel joint through the additional annular cavity without communicating through the annular cavity.

15. The method of claim 14, further comprising axially moving the piston assembly relative to the sleeve assembly.

16. The method of claim 15, wherein axially moving the piston assembly comprises releasing a releasable fastener coupled to the piston assembly.

17. The method of claim 14, further comprising rotating the piston assembly relative to the sleeve assembly.

* * * * *